US005934230A

United States Patent [19]

Uytdewilligen et al.

[11] Patent Number: 5,934,230

[45] Date of Patent: Aug. 10, 1999

[54] METHOD FOR SUPPLYING FUEL TO A COMBUSTION ENGINE, AND COMBUSTION ENGINE

[75] Inventors: Frederikus Uytdewilligen, Doetinchem; Raymond Wentink, Hengelo Gld., both of Netherlands

[73] Assignee: Tumic Research B.V., Doetinchem, Netherlands

[21] Appl. No.: 08/930,025

[22] PCT Filed: Mar. 20, 1996

[86] PCT No.: PCT/NL96/00118

§ 371 Date: Apr. 23, 1998

§ 102(e) Date: Apr. 23, 1998

[87] PCT Pub. No.: WO96/29510

PCT Pub. Date: Sep. 26, 1996

[30] Foreign Application Priority Data

Mar. 20, 1995 [NL] Netherlands ..... 9500548

[51] Int. Cl.[6] ..... F02B 3/00

[52] U.S. Cl. ..... 123/73 R

[58] Field of Search ..... 123/73 R, 73 A, 123/436, 675, 677, 678

[56] References Cited

U.S. PATENT DOCUMENTS

| | | | |
|---|---|---|---|
| 4,034,730 | 7/1977 | Ayres et al. . | |
| 4,048,964 | 9/1977 | Kissel . | |
| 4,205,648 | 6/1980 | Graham . | |
| 4,779,581 | 10/1988 | Maier | 123/73 A |
| 5,140,964 | 8/1992 | Torigai | 123/73 A |
| 5,215,068 | 6/1993 | Kato | 123/73 R |
| 5,450,830 | 9/1995 | Katoh | 123/73 A |
| 5,690,063 | 11/1997 | Motoyama et al. | 123/73 A |

FOREIGN PATENT DOCUMENTS

| | | |
|---|---|---|
| 1 157 709 | 6/1958 | France . |
| 2 136 587 | 12/1972 | France . |

*Primary Examiner*—Marguerite McMahon
*Attorney, Agent, or Firm*—Evenson, McKeown, Edwards & Lenahan PLLC

[57] ABSTRACT

The invention relates to a method for supplying fuel to a combustion engine which has an air inlet provided with a gas valve and an output shaft and wherein a fuel line in which a fuel supply device is arranged debouches into the air inlet. The method comprises of providing a pump with an adjustable, substantially continuous flow rate for the fuel supply device, determining the position of the gas valve, determining the rotation speed of the shaft, ascertaining herewith the required fuel flow rate and adjusting the pump accordingly. The invention further relates to a combustion engine of which the fuel supply is controlled as according to the above specified method.

18 Claims, 1 Drawing Sheet

METHOD FOR SUPPLYING FUEL TO A COMBUSTION ENGINE, AND COMBUSTION ENGINE

BACKGROUND AND SUMMARY OF THE INVENTION

The invention relates to a method for supplying fuel to a combustion engine which has an air inlet provided with a gas valve and an output shaft and wherein a fuel line in which a fuel supply device is arranged debauches into the air inlet, comprising of providing a pump with an adjustable, substantially continuous flow rate for the fuel supply device, determining the position of the gas valve, determining the rotation speed of the shaft, ascertaining the required fuel flow rate and adjusting the pump accordingly.

A method of this kind is known from U.S. Pat. No. 4,048,964. The main control signal for adjusting the pump is obtained from a volumetric air flow meter. The derived signal is further adjusted with signals representing the position of the gas valve and the rotational speed of the motor shaft, amongst other signals.

Due to the delay of the air flow meter, the control of the combustion engine has a considerable time constant, at first affecting the accurate control of the fuel supply.

The invention now has for its object to provide a method for supplying fuel which enables very rapid control such that this is suitable for fast-running engines, such as two-stroke racing engines which can have a rotation speed of up to 18,000 rpm.

This object is achieved with the method according to the invention in that the required fuel flow rate is ascertained with the determined position of the gas valve and the determined rotation speed of the shaft. Both the gas valve position and the rotation speed can be determined with a very small time constant.

The required fuel flow rate can be calculated for instance with a suitable algorithm. Preferably however, the required fuel flow rate is determined on the basis of a pre-configured matrix in which various gas valve positions and shaft rotation speeds are related to an associated fuel flow rate suitable for a desired operating mode of the engine. A high processing speed can be hereby achieved.

The matrix can be configured by calculation. The matrix is preferably at least partially configured by including therein values wherein the oxygen content of exhaust gases determined with a lambda probe arranged in an outlet of the engine has an optimal value. It is of course also possible herein to use a self-learning method, wherein the values stored in the matrix are gradually optimized during operation of the engine on the basis of simultaneously performed measurements with the lambda probe.

A further refinement of the method according to the invention is achieved by determining at least one parameter, such as the absolute pressure of air flowing through the air inlet, and correcting the determined fuel flow rate accordingly. As for instance the air pressure, air temperature and air humidity vary, modified fuel flow rates can be provided so that a desired optimum operation is obtained under all operating conditions.

The step of determining a rate of change of the shaft rotation speed and adjusting the fuel flow rate based on that rate of change, for a predetermined time duration, is preferably applied particularly in the case of fast-running engines such as racing engines. Due to the "predictive" control a time constant for the control practically equal to zero can be realized. The combustion engine will thus herein obtain the optimum fuel supply at virtually any given moment, both during constant and greatly varying operating conditions.

The invention likewise relates to and provides a combustion engine comprising at least one cylinder, a reciprocally moveable piston therein which can drive an output shaft via a transmission, an air inlet which is connected to the cylinder and in which is arranged a gas valve, fuel supply means debauching into the air inlet and comprising a pump with an adjustable, substantially continuous flow rate, control means for controlling the pump, sensors connected to the control means for at least the shaft rotation speed and the gas valve position, wherein the control means are programmed such that they control the pump in the manner as described above.

Preferably, the air inlet comprises a channel of a determined section and the gas valve comprises a valve body with a revolution surface rotatable in accordance with an axis intersecting the channel, which valve body is provided with a transverse channel which in an open position of the gas valve forms one continuous whole with the channel and wherein the fuel supply means comprise a vaporizer debauching into the transverse channel.

In the fully open position of the gas valve the intake air passes through the valve completely unimpeded, so that the cylinder can be filled with a maximum fuel/air mixture. During partial load the transverse channel of the valve body lies at an angle to the channel of the air inlet wherein edges of the valve body protrude in the channel of the air inlet. This results in very strong vortices which ensure good mixing of the injected fuel with the through-flowing air. This is of particular importance in the present invention because the fuel is continuously injected, while at lower rotation speeds the intake air flow has a pulsating component and the air speed is therein lower. Due to the specific embodiment of the gas valve very good mixing of the injected Fuel with the combustion air is also achieved under these conditions.

The pump is preferably a gear pump. This provides a very uniform output which is proportional to the rotation speed.

A suitable driving of the pump can be achieved with a direct current electric motor. The direct current electric motor can be controlled very precisely with per se known electronic control units.

A further development of the invention is characterized by moving the gas valve with a control motor which is regulated by the control device in accordance with the shaft rotation speed, the gas valve position and the position of a hand or foot-operated control member. Because the gas valve is not directly moved by the hand or foot-operated control member, it is possible through the control means to realize at all times an optimum adjustment of the gas valve for the momentary air flow and the momentary fuel flow rate and thus an optimal mixing of the fuel with the air. When full power is demanded from zero load and the control member is moved into the fully open position, a poor mixing of the fuel and air would occur in the case of a direct coupling because of the initially still low air speed.

Other objects, advantages and novel features of the present invention will become apparent from the following detailed description of the invention when considered in conjunction with the accompanying drawings.

DETAILED DESCRIPTION OF THE DRAWINGS

Figure 1:
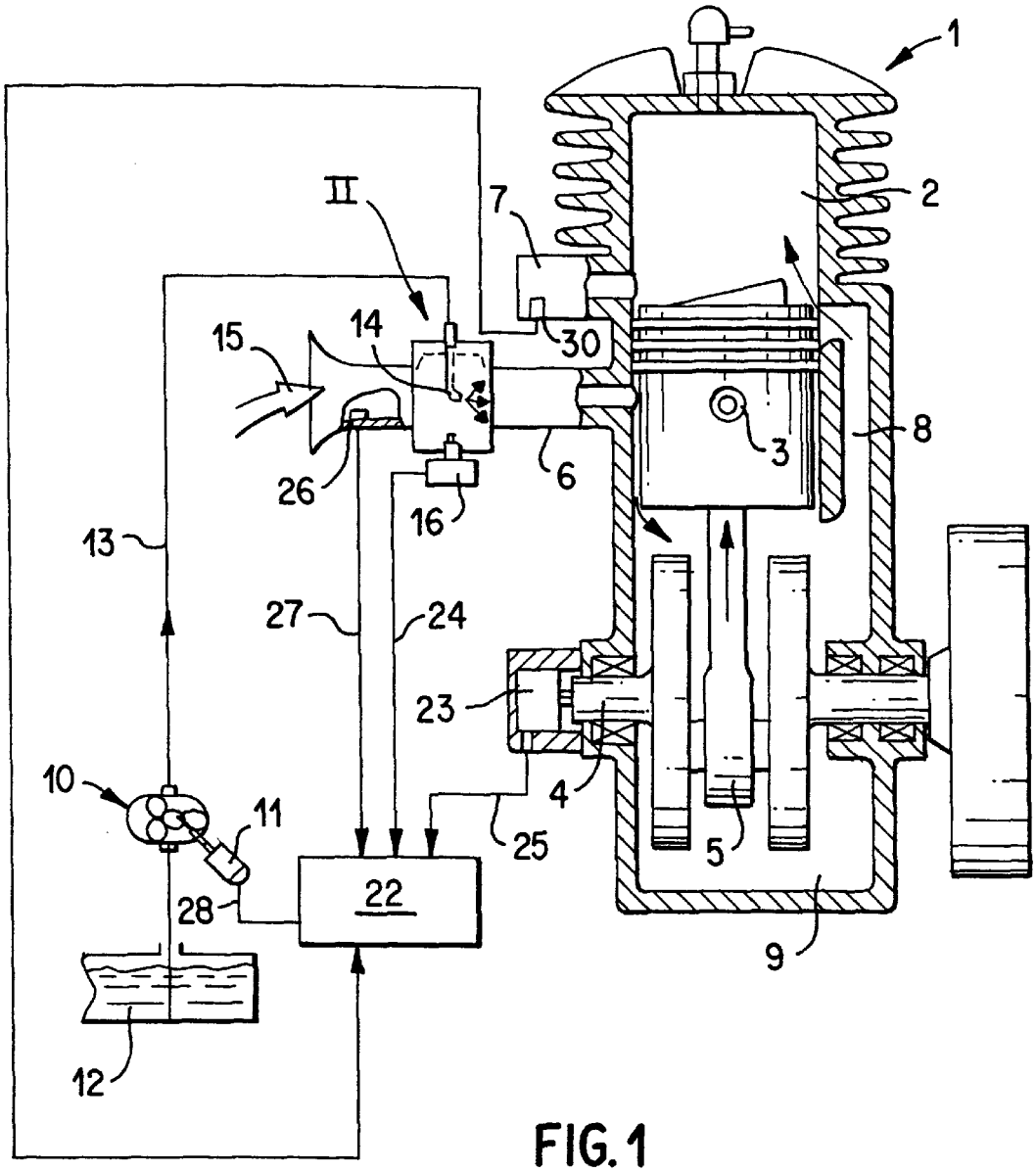
FIG. 1 shows schematically in partial section a combustion engine with a fuel supply embodied according to the method of the invention.

The engine 1 shown in FIG. 1 is of the two-stroke type. This engine 1 comprises a cylinder 2 in which a reciprocating piston 3 is arranged. The piston 3 drives via a connecting rod 5 the crankshaft 4 mounted in the engine block.

The engine further comprises an air inlet 6 into which debouch fuel supply means to be described further.

Since the engine, as stated, is of the two-stroke type, the fuel/air mixture drawn in from the air inlet is sucked into the crankcase 9 of engine 1 during the upward stroke of piston 3. At the and of the downward operating stroke of piston 3 the latter leaves clear the flushing channel 8 whereby the entrained fuel/air mixture from crankcase 9 can enter cylinder 2 via flushing channel 8. In the subsequent upward stroke of piston 3 the mixture is compressed and ignited, whereafter a downward operating stroke of piston 3 occurs once again. Close to the end of the downward stroke of piston 3 the outlet 7 is left clear whereby combustion gas can escape via this outlet 7. Immediately thereafter the top part of piston 3 again passes over the flushing channel 8 whereby fresh mixture is supplied and the cycle is repeated.

For the supply or the fuel in the air 15 a pump 10 is applied according to the invention which has an adjustable, substantially continuous flow rate. The fuel is thus not injected in pulsating manner in accordance with the movements of the piston but in one continuous jet.

The pump 10 is arranged in a fuel line 13 which leads from a fuel tank 12 to a vaporizer 14 debouching into the air inlet 6.

Figure 2:
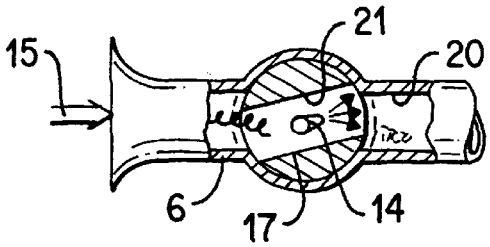
FIG. 2 shows a sectional detail as according to arrow II in FIG. 1.

As shown more particularly in FIG. 2, the gas valve in the shown preferred embodiment is embodied as a valve body 17 with a revolution surface. The axis of symmetry of valve body 17 defines an axis which intersects the channel 20 of the air inlet and around which valve body 17 is rotatable. The valve body 17 has a transverse channel 21 which, in the fully open position of the valve, forms one continuous whole with channel 20, so that the air 15 can pass through the valve without any obstruction. In the partially open position as shown in FIG. 2, edges of the valve body 17 protrude into channel 20 whereby the entrain air 15 is set into strong vortices. The fuel injected by the vaporizer 14 is wall mixed with the air due to these vortices, so that it can vaporize well and form a uniform mixture with the air.

In this preferred embodiment the pump 10 is driven by a direct current electric motor which is controlled by the control device 22 via a control line 28.

The control device 22 generates via control line 28 a control signal to the motor 11 which depends on a number of parameters, in particular the position of the gas valve 17 and the rotation speed of the shaft 4 of the engine.

The position of the gas valve is determined with sensor 16 and supplied to the control device 22 via control line 24. The rotation speed or shaft 4 is determined with sensor 23 and supplied to the control device 22 via signal line 25.

Instead of determining the rotation speed using a separate sensor 23 a determination of the rotation speed co-acting with the ignition signal can of course also be used.

In the embodiment shown here, in addition to determination of the rotation speed and determination of the gas valve position, a further determination of several parameters of the air 15 is applied. A sensor 26 for this purpose is connected via a signal line 27 to the control device 22. The quantities for determining with sensor 26 comprise for instance the absolute pressure of the air 15 and the temperature and humidity thereof.

The control device 22 comprises a central processing unit which processes the signals supplied via the lines 24, 25 and 27 and on the basis thereof generates the control signal to be supplied to the motor 11, so that an optimum fuel supply associated with the measured values is generated.

Generation of the control signal preferably takes place in that the control device 22 comprises a memory member in which a matrix of gas valve positions, shaft rotation speeds and associated fuel flow rates is stored. The processing unit can thus determine very rapidly on the basis of the matrix which fuel flow rate is associated with the measured gas valve position and the measured rotation speed and control the motor 11 accordingly. The signal from sensor 26 can herein be used as a correction signal with which the determined value is adjusted in the one or other direction. The matrix may be at least partially configured by including therein values wherein the oxygen content of exhaust gases determined with a lambda probe 30 arranged in the outlet 7 of the engine has an optimal value.

The gas valve 17 is preferably controlled by a control motor (not shown) which is regulated by the control device 22 in accordance with the shaft rotation speed, the gas valve position and the position of a hand or foot-operated control member (not shown). Thus, an incomplete mixing of the fuel with the combustion air 15, due to too rapid an operation of the gas valve 17, can be prevented.

It is noted that the invention is not limited to use in a one cylinder two-stroke engine as depicted in FIG. 1. It is however the case that in a high-speed two-stroke engine the intake air flow is practically continuous, and thus includes little or no pulse component, so that the conditions for mixing of this air with the continuously supplied fuel is optimal. However, with a sufficient volume of the air inlet conduit or when different cylinders operating out-of-phase are connected to the same air inlet, suitable air flow conditions will also occur wherein the invention can be effectively applied.

We claim:

1. Method for supplying fuel to a combustion engine which has an air inlet provided with a gas valve and an output shaft and wherein a fuel line in which a fuel supply device is arranged debauches into the air inlet, said method comprising: providing a pump with an adjustable, substantially continuous flow rate for the fuel supply device, determining a position of the gas valve, determining a rotation speed of the shaft, determining a required fuel flow rate directly from the position of the gas valve and the rotation speed of the shaft, and adjusting the pump to supply the required fuel flow rate.

2. Method as claimed in claim 1, wherein the required fuel flow rate is determined on the basis or a pre-configured matrix in which various gas valve positions and shaft rotation speeds are related to an associated fuel flow rate suitable for a desired operating mode of the engine.

3. Method as claimed in claim 2, wherein the matrix is at least partially configured by including therein values wherein the oxygen content of exhaust gases determined with a lambda probe arranged in an outlet of the engine has an optimal value.

4. Method as claimed in claim 1, wherein at least one of the absolute pressure, the temperature, and the humidity of air flowing through the air inlet is determined and the fuel flow rate is corrected accordingly.

5. Method as claimed in claim 1, wherein a rate of change of the shaft rotation speed is determined and the pump is adjusted to generate a fuel flow rate based on the rate of change, for a predetermined time duration.

6. Combustion engine operated according to the method of claim 1 comprising at least one cylinder, a reciprocally moveable piston therein which can drive an output shaft via a transmission, an air inlet which is connected to the cylinder and in which is arranged a gas valve, fuel supply means debouching into the air inlet and comprising a pump with an adjustable, substantially continuous flow rate, control means for controlling the pump, sensors connected to the control means for at least the shaft rotation speed and the gas valve position, characterized in that the control means are programmed such that they control the pump in the manner as claimed in claim 1.

7. Combustion engine as claimed in claim 6, wherein the air inlet comprises a channel of a determined section and the gas valve comprises a valve body with a revolution surface rotatable about an axis intersecting the channel, which valve body is provided with a transverse channel which in an open position of the gas valve forms one continuous whole with the channel and wherein the fuel supply means comprise a vaporizer debauching into the transverse channel.

8. Combustion engine as claimed in claim 6, being a two-stroke engine.

9. Combustion engine as claimed in claim 5, wherein the pump is a gear pump.

10. Combustion engine as claimed in claim 5, wherein the pump comprises a direct current electric motor.

11. Combustion engine as claimed in claim 5, wherein the gas valve is moved by a control motor which is regulated by the control device in accordance with the shaft rotation speed, the gas valve position and the position of a hand or foot-operated control member.

12. Method as claimed in claim 1, wherein the required fuel flow rate is determined independently of a quantity of air flowing through the air inlet.

13. A method for supplying fuel to a combustion engine having an output shaft, an air inlet, a gas valve arranged in said air inlet, a fuel supply device arranged in said air inlet, and a pump with an adjustable flow rate providing fuel to said fuel supply device, said method comprising the steps of:

determining a position of said gas valve;

determining a rotation speed of said output shaft;

determining a required fuel flow rate directly from said position of said gas valve and said rotation speed of said shaft; and adjusting said pump to provide said required fuel flow rate.

14. A method according to claim 13, wherein said required fuel flow rate is determined using a pre-configured matrix containing values of said fuel flow rate corresponding to a plurality of said gas valve positions and a plurality of said shaft rotation speeds.

15. A method according to claim 13, wherein said required fuel flow rate is determined independently of a quantity of air flowing through said air inlet.

16. A fuel supply system for a combustion engine having an output shaft, an air inlet, a gas valve arranged in said air inlet, a fuel supply device arranged in said air inlet, and a pump with an adjustable flow rate providing fuel to said fuel supply device, said system comprising:

means for determining a position of said gas valve;

means for determining a rotation speed of said output shaft;

means for determining a required fuel flow rate directly from said position of said gas valve and said rotation speed of said shaft; and means for adjusting said pump to provide said required fuel flow rate.

17. A fuel supply system according to claim 16, wherein said means for determining said required fuel flow rate comprises a pre-configured matrix containing values of said fuel flow rate corresponding to a plurality of said gas valve positions and a plurality of said shaft rotation speeds.

18. A fuel supply system according to claim 16, wherein said means for determining said required fuel flow rate determines said required fuel flow rate independently of a quantity of air flowing through said air inlet.

* * * * *